US005274388A

United States Patent [19]

Ishizaki et al.

[11] Patent Number: 5,274,388

[45] Date of Patent: Dec. 28, 1993

[54] ANTENNA DEVICE

[75] Inventors: Toshio Ishizaki, Kobe; Hiroaki Kosugi; Tomoki Uwano, both of Hirakata; Toshio Sekiguchi, Kawasaki, all of Japan

[73] Assignee: Matsushita Electric Industrial Co., Ltd., Osaka, Japan

[21] Appl. No.: 836,431

[22] Filed: Feb. 18, 1992

[30] Foreign Application Priority Data

Feb. 18, 1991 [JP] Japan ..... 3-023141

[51] Int. Cl.[5] ..... H01Q 1/36

[52] U.S. Cl. ..... 343/725; 343/876; 343/895

[58] Field of Search ..... 343/726, 895, 876, 725, 343/702; 455/277

[56] References Cited

U.S. PATENT DOCUMENTS 4,670,717 6/1987 Sender ..... 343/726

OTHER PUBLICATIONS

"The Helical Antenna", J. D. Kraus. 7-3 Transmission and Radiation Modes of Monofilar Helices, pp. 274–277.

*Primary Examiner*—Michael C. Wimer

*Attorney, Agent, or Firm*—Wenderoth, Lind & Ponack

[57] ABSTRACT

A small-sized antenna device is used for portable telephone equipment and is capable of preventing the receiving strength from being degraded due to a change in the application environment as well as the mounting thereof onto a small radio equipment case. The antenna device has a linear antenna for producing an electric current flux and a coil-shaped antenna for producing a magnetic current flux including a plurality of half-wavelength helical coils connected in series so as to have two adjacent coils coiled in opposite directions with respect to each other, and carries out polarization diversity. Degradation in the characteristics of both antennas due to differences in operational principle can be prevented from taking place simultaneously, resulting in realizing a good reception of a radiowave. In addition, the antenna axes of both antennas can be disposed in parallel and close to each other, thus miniaturizing the device itself.

3 Claims, 4 Drawing Sheets

RADIATION PATTERN IN A VERTICAL PLANE
FOR HORIZONTAL ELECTRIC FIELD

IMPEDANCE

ANTENNA DEVICE

BACKGROUND OF THE INVENTION

1. Field of the Invention

This invention relates to an antenna device to be used mainly for portable telephone equipment.

2. Description of the Prior Art

Recently, antenna devices to be used for portable telephone equipment have been attracting great importance to be provided with a performance of preventing the receiving strength from being degraded due to change in application environment. For this, a conventional antenna device comprises a first linear antenna for producing an electric current flux and a second linear antenna for producing an electric current flux which are disposed perpendicularly with respect to each other. With the antenna device arranged as above, the operation will be explained below.

First, both the first linear antenna and the second linear antenna receive a radiowave. With conventional portable telephone equipment, degradation in the receiving strength characteristics due to a change in application environment will take place, particularly when the telephone is used while being handheld, the receiving strength characteristic is degraded due to influences of adjacent bodies including human bodies and/or a deviation of the setting angle of the device from the horizontal level.

In order to overcome these disadvantages, an improvement has been made in that the second linear antenna has its antenna axis disposed perpendicular to that of the first linear antenna to produce different radiowave environments by the respective antennas, and the outputs of two receivers are monitored to switch them to the antenna which is in the better receiving condition. This is called polarization diversity (for example, refer to: T. Utano; "Propagation Characteristics of Polarization Diversity Reception at Base Locations for Mobile Radio", IEICE, vol. J63-B. No. 5, PP. 540-541, May 1980).

With the conventional antenna device as such, all plural antennas to be used are linear antennas having the same basic operational principle, so that they will be degraded in characteristics by any adjacent bodies including human bodies in the same manner, which means that a problem has arisen in that two antennas to be used are simultaneously degraded in characteristics, so that sufficient diversity effect cannot be obtained.

In addition, the first and second antennas are set so as to have their antenna axes disposed perpendicular to each other, which means that they must be disposed into two different directions, thus making miniaturization of a device disadvantageously difficult. In addition, with an arrangement as shown above, such a problem has been pointed out in that the linear antenna having its antenna axis disposed horizontally does not have a horizontal plane omni-directivity.

SUMMARY OF THE INVENTION

An object of this invention is to provide a small-sized antenna device which can prevent its receiving strength from being degraded due to change in application environment and can be mounted onto a small-sized radio equipment case.

In order to attain the above-mentioned object, an antenna device of this invention comprises a linear antenna for producing an electric current flux, a coil-shaped antenna for producing a magnetic current flux and having a plurality of helical coils each of which has a line length of a half-wavelength and which are connected in series so as to have two adjacent coils coiled in opposite directions with respect to each other, an antenna axis of the coil-shaped antenna being in parallel to that of the linear antenna, and a diversity switch thereby performing a polarization diversity.

With the antenna device structured as above, the linear antenna for producing an electric current flux and receiving the electric field and the coil-shaped antenna for producing a magnetic current flux and receiving the magnetic field of a radiowave are used together, thereby having different behaviors of characteristic degradation when the application environment is varied, so that the characteristic degradation of both antennas can be prevented from taking place simultaneously. In addition, though both antennas also have horizontal plane omni-directivity, from the fact that the electric field and magnetic field of a radiowave are applied perpendicularly to each other, when the antenna axes of both antennas are made parallel, their polarization planes can be made to perpendicularly cross each other. In addition, even if both antennas, linear and coil-shaped, are disposed close to each other, almost no degradation in characteristic results, so that they may be disposed close to each other.

By combining the linear antenna for producing a electric current flux and the coil-shaped antenna for producing a magnetic current flux for effecting polarization diversity as shown above, even when application environment is varied, a good reception of a radiowave can be always realized, and at the same time, from the fact that the both antennas can be disposed with their antenna axes in parallel direction and get close to each other, a compact device is possible.

DETAILED DESCRIPTION OF THE PREFERRED EMBODIMENTS

Figure 1:
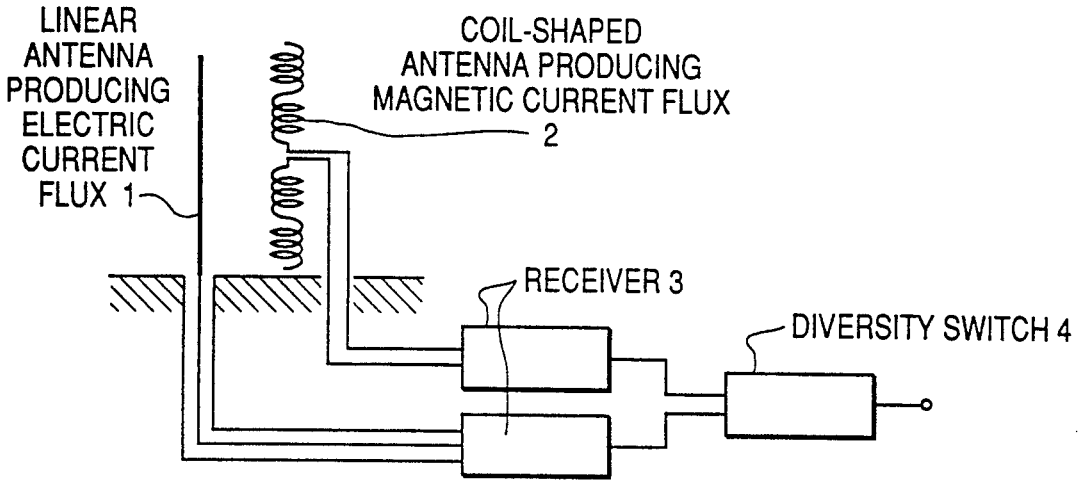
FIG. 1 is a block diagram of an antenna device according to a first embodiment of this invention.

FIG. 1 schematically shows an antenna device according to a first embodiment of this invention.

In FIG. 1, 1 is a linear antenna for producing an electric current flux; element 2 is a coil-shaped antenna for producing a magnetic current flux; element 3 is a receiver, and element 4 is a diversity switch; the antenna axis of the linear antenna 1 and that of the coil-shaped antenna 2 are parallel to each other.

With the antenna device as structured as above, the operation thereof will be explained below by referring to FIGS. 1 and 2.

First, a radiowave is received by both of the linear antenna 1 and the coil-shaped antenna 2. As already described above, in case of using portable telephone equipment, a problem can disadvantageously arise in that the receiving strength thereof is degraded due to the influences of adjacent bodies including human bodies and/or deviation of the setting angle of the equipment from the horizontal level.

In order to overcome this problem, this device is sophisticated in that the outputs of these two receivers are monitored to switch to the antenna having the better receiving condition, so that good reception of the radiowave can always be provided. As the receiver, there may be a post-detection diversity reception including up to a demodulator and a predetection diversity reception including an RF (radio frequency) amplifier or frequency converter only but not including the demodulator. Or, it is possibly structured by coupling the antenna directly with a diversity switch without using any receiver. The principle of diversity is the same as that of the prior art.

On the combination of a dipole antenna and a loop antenna, an example is shown in, for example, W. C. Y. Lee et al: "Polarization Diversity System for Mobile Radio", IEEE Trans. Commun., Com-20,pp. 912–923, October, 1972. In this case, however, the loop antenna has a horizontal plane directivity with a large number of lobe and null points, which is not a good property of a portable telephone.

Figure 2:
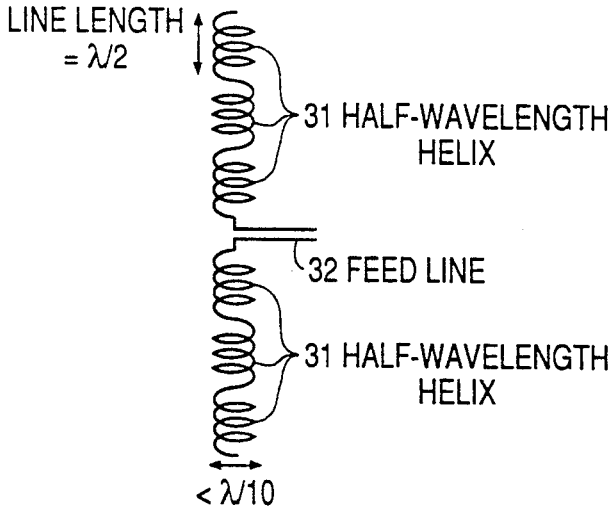
FIG. 2 is a schematic diagram of a coil-shaped antenna for producing a magnetic current flux.

A feature of the antenna device of this invention is as shown in FIG. 2, namely a coil-shaped antenna for producing a magnetic current flux consists of a plurality of helices with a half-wavelength 31 as the unit element and connected in series so as to have the adjacent coils coiled in opposite directions with respect to each other.

In this case, the diameter of the helix 31 is generally made below one-tenth wavelength, and the normal mode is used as a radiation mode. (See, for example, J. D. Kraus; "Antennas" second edition, p. 274, McGraw-Hill.)

The coil-shaped antenna for producing a magnetic current flux, different from the loop antenna, can increase the gain in the horizontal direction by connecting a plurality of loop elements in series, thus realizing the optimum property as an antenna used for a portable telephone.

In addition, the linear antenna and coil-shaped antenna are different in operational principle in that the former has an antenna element excited by the electric field and the latter has the antenna element excited by a magnetic field of an electromagnetic wave, which means that they are differently influenced by the change of their application environment.

Figure 3A:
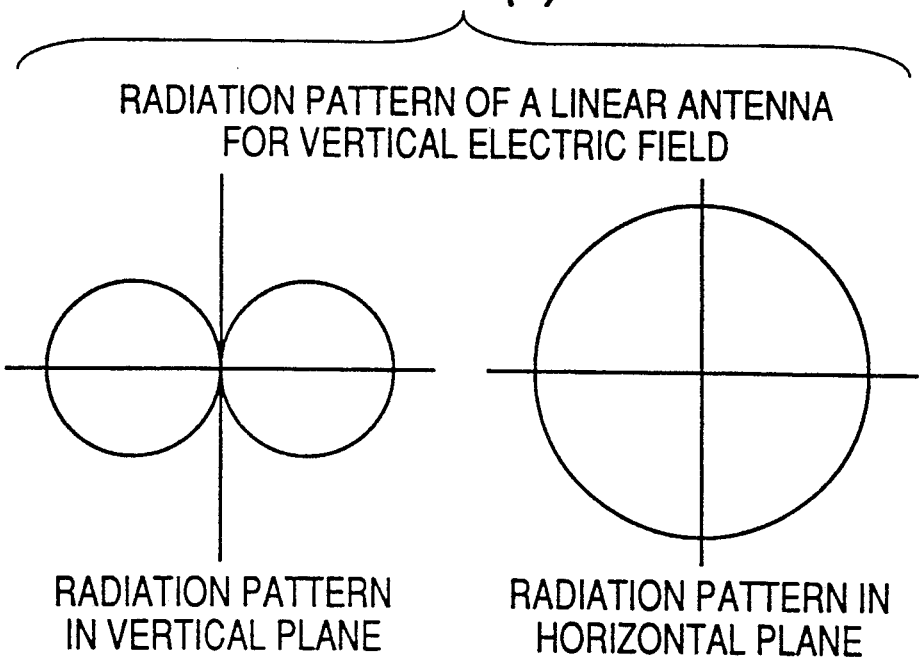
FIGS. 3(*a*) and 3(*b*) are diagrams respectively showing a directional characteristic of a linear antenna for producing a electric current flux and that of a coil-shaped antenna for producing a magnetic current flux.
Figure 3B:
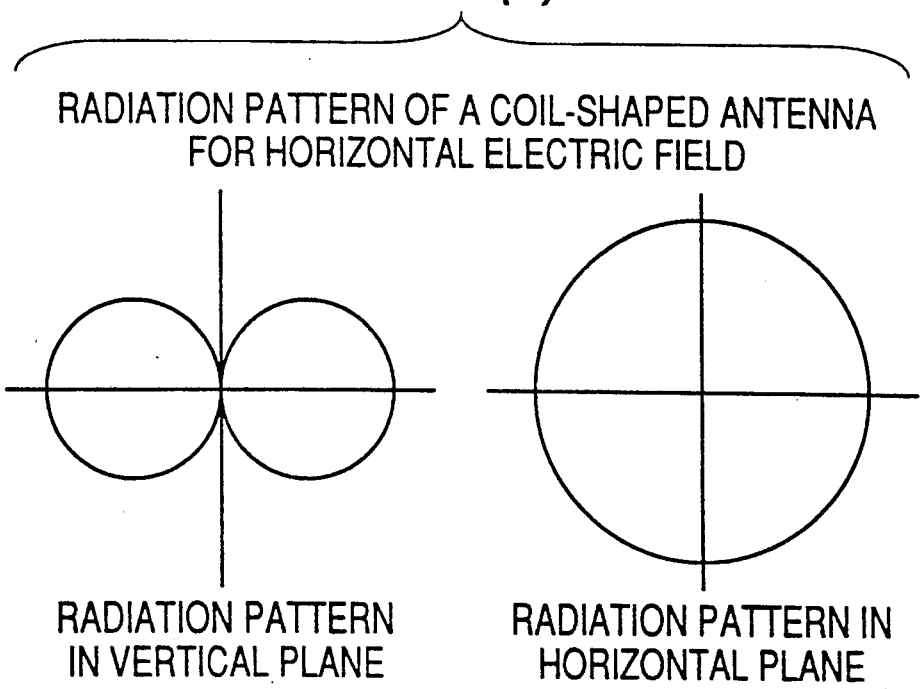

The directivities of the both antennas when the antenna axis is in the vertical direction are shown in FIGS. 3(*a*) and 3(*b*). In this case, however, the polarization plane direction of an electric field is made vertical in case of the linear antenna and horizontal in case of the coil-shaped antenna. The linear antenna has a horizontal plane omni-directivity for the vertical electric field and on the other hand, the coil-shaped antenna has a horizontal plane omni-directivity for the horizontal electric field. The electric field and magnetic field of a radiowave perpendicularly cross each other, so that the reception is made only by one of the in general. Where degradation of the receiving strength due to a change in application environment is generated, the polarization diversity can be carried out by the two antennas.

Figure 4A:
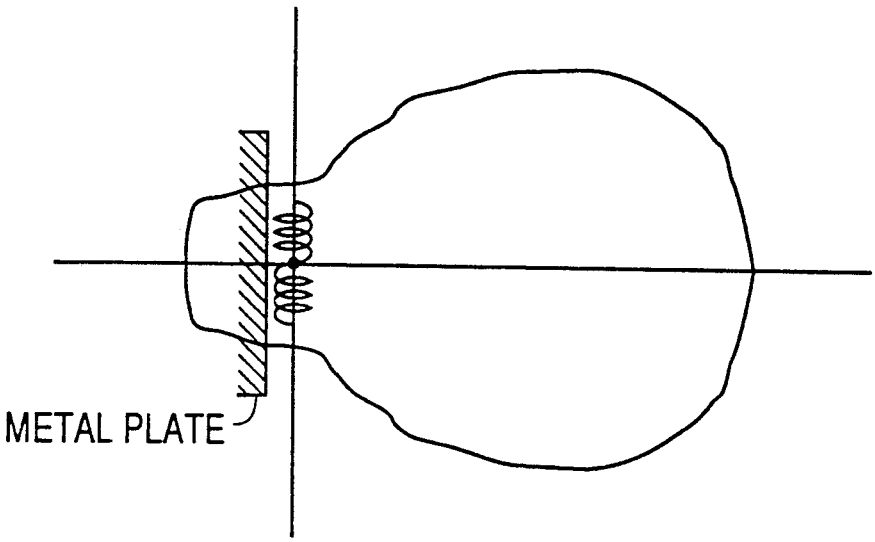
FIGS. 4(*a*) and 4(*b*) are diagrams showing the characteristics of a coil-shaped antenna for producing a magnetic current flux when a grounded metal plate approaches.
Figure 4B:
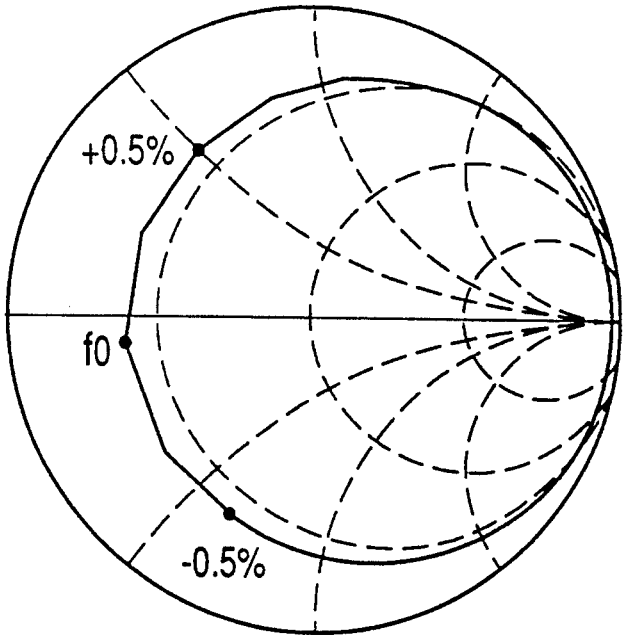

In this case, mutual influences between the antennae are small. FIGS. 4(*a*) and 4(*b*) respectively show a directivity pattern and impedance characteristic when a metal plate approaches a coil-shaped antenna consisting of two unit elements. From the experiments, it was revealed that the coil-shaped antenna exhibits almost no degradation of characteristics even when a metal conductor approaches thereto. The degradation of characteristics of the coil-shaped antenna when a linear antenna for producing an electric current flux approaches thereto is negligibly small as compared with this. In addition, for the linear antenna, the coil-shaped antenna is small in size and spatial shielding area, so that even when the both antennas are disposed close to each other, almost no degradation in characteristics results. As a result, the setting distance between the both antennas can be made small, possibly resulting in miniaturization of the device. The setting distance between them may be below one quarter-wavelength.

As explained above, according to the first embodiment of this invention, even when the application environment is varied, simultaneous degradation in characteristics of both antennas can be prevented, so that a good reception can be always obtained and at the same time, the antenna axes thereof can be disposed in parallel close to each other, so that the device itself can be miniaturized.

Next, explanations will be made below on an antenna device according to a second embodiment of this invention while referring to the drawings.

Figure 5:
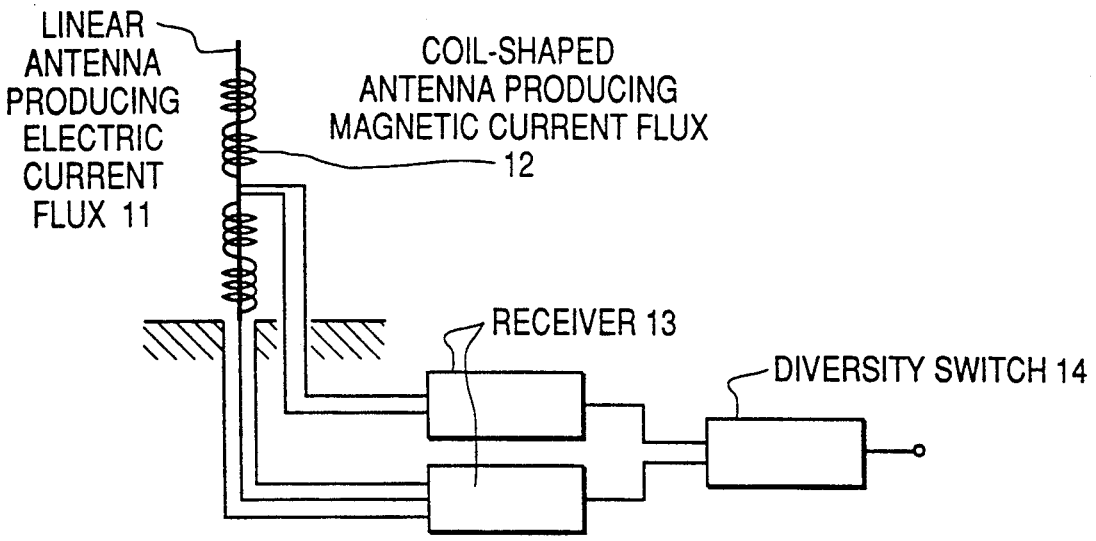
FIG. 5 is a block diagram of an antenna device according to a second embodiment of this invention.

FIG. 5 schematically shows an antenna device according to the second embodiment of this invention, in which element 11 is a linear antenna for producing an electric current flux, and element 12 is a coil-shaped antenna for producing a magnetic current flux, which are the same as those shown in FIG. 1.

What is different from that shown in FIG. 1 is that the linear antenna 11 is disposed so as to be surrounded by the unit elements of the coil-shaped antenna 12. The electric field of an incident radiowave is received by the linear antenna 11 and the magnetic field thereof is received by the coil-shaped antenna. As already described above, the electric field and magnetic field of a radiowave perpendicularly cross each other, and the radiowave is received by either the linear or the coil-shaped antenna in general, so that mutual influences between the both antennas during operation are small. As a result, even if the linear antenna is disposed so as to be surrounded by the unit elements of the coil-shaped antenna, the characteristic of each of the two antennas results in almost no degradation. As the linear antenna for producing an electric current flux, a monopole antenna as shown in FIG. 5 or a dipole antenna can be used.

As shown above, by disposing the linear antenna 11 so as to be surrounded by the unit elements of the coil-shaped antenna 12, the antenna device itself can be further miniaturized.

What is claimed is:

1. An antenna device comprising:

a linear antenna for producing an electric current flux and having omni-directivity on a plane perpendicular to a longitudinal direction thereof for an electric field having a polarization plane direction parallel to said longitudinal direction;

a coil-shaped antenna for producing a magnetic current flux which has a longitudinal axis parallel to that of said linear antenna and comprises a plurality of helical coils each having a center axis parallel to the longitudinal axis of said coil-shaped antenna and a length of a half-wavelength of a radiowave to be received in a direction of the longitudinal axis thereof, said plurality of helical coils being arranged so that the center axes thereof extend along the longitudinal axis of said coil-shaped antenna and connected in series so that helical directions of each adjacent two of said plurality of helical coils are opposite to each other whereby said coil-shaped antenna has omni-directivity on the plane perpendicular to the longitudinal direction of said linear antenna for an electric field having a polarization plane direction perpendicular to said longitudinal direction; and a diversity switch coupled to both said linear antenna and said coil-shaped antenna for effecting a polarization diversity.

2. An antenna device as claimed in claim 1, wherein said linear antenna is disposed so as to be surrounded by the helical coils of said coil-shaped antenna.

3. An antenna device as claimed in claim 1, wherein each of said plurality of helical coils has a diameter which is shorter than one tenth wavelength of the radiowave to be received.

* * * * *